US008370153B2

(12) United States Patent
Hirose et al.

(10) Patent No.: US 8,370,153 B2
(45) Date of Patent: Feb. 5, 2013

(54) SPEECH ANALYZER AND SPEECH ANALYSIS METHOD

(75) Inventors: Yoshifumi Hirose, Kyoto (JP); Takahiro Kamai, Kyoto (JP)

(73) Assignee: Panasonic Corporation, Osaka (JP)

( * ) Notice: Subject to any disclaimer, the term of this patent is extended or adjusted under 35 U.S.C. 154(b) by 347 days.

(21) Appl. No.: 12/772,439

(22) Filed: May 3, 2010

(65) Prior Publication Data

US 2010/0204990 A1 Aug. 12, 2010

Related U.S. Application Data

(63) Continuation of application No. PCT/JP2009/004673, filed on Sep. 17, 2009.

(30) Foreign Application Priority Data

Sep. 26, 2008 (JP) ..... 2008-248536

(51) Int. Cl.
*G10L 13/00* (2006.01)
*G10L 13/06* (2006.01)
*G10L 21/02* (2006.01)

(52) U.S. Cl. ..... 704/261; 704/263; 704/265; 704/275; 704/226

(58) Field of Classification Search ..... 704/226, 704/261, 263, 265, 275
See application file for complete search history.

(56) References Cited

U.S. PATENT DOCUMENTS 5,774,846 A * 6/1998 Morii ..... 704/232
5,826,221 A * 10/1998 Aoyagi ..... 704/200
5,956,685 A * 9/1999 Tenpaku et al. ..... 704/278
5,983,173 A * 11/1999 Inoue et al. ..... 704/219
6,205,421 B1 * 3/2001 Morii ..... 704/226
6,317,713 B1 * 11/2001 Tenpaku ..... 704/261
6,349,277 B1 2/2002 Kamai et al.
6,490,562 B1 * 12/2002 Kamai et al. ..... 704/258
6,594,626 B2 * 7/2003 Suzuki et al. ..... 704/220
6,658,380 B1 * 12/2003 Lockwood et al. ..... 704/215
7,010,488 B2 * 3/2006 van Santen et al. ..... 704/258

(Continued)

FOREIGN PATENT DOCUMENTS

JP 9-152896 6/1997
JP 2002-169599 6/2002

(Continued)

OTHER PUBLICATIONS

Nobuyuki Nishizawa "Separation of Voiced Source Characteristics and Vocal Tract Transfer Function Characteristics for Speech Sounds by Iterative Analysis Based on AR-HMM Model", www.gavo.t.u-tokyo.ac.jp/~mine/.../ICSLP_p1721-1724_t2002-9.pd., pp. 1721-1724.*

(Continued)

*Primary Examiner* — Pierre-Louis Desir
*Assistant Examiner* — Abdelali Serrou
(74) *Attorney, Agent, or Firm* — Wenderoth, Lind & Ponack, L.L.P.

(57) ABSTRACT

A speech analyzer includes a vocal tract and sound source separating unit which separates a vocal tract feature and a sound source feature from an input speech, based on a speech generation model, a fundamental frequency stability calculating unit which calculates a temporal stability of a fundamental frequency of the input speech in the sound source feature, from the separated sound source feature, a stable analyzed period extracting unit which extracts time information of a stable period, based on the temporal stability, and a vocal tract feature interpolation unit which interpolates a vocal tract feature which is not included in the stable period, using a vocal tract feature included in the extracted stable period.

16 Claims, 11 Drawing Sheets

U.S. PATENT DOCUMENTS

| | | | | |
|---|---|---|---|---|
| 8,165,882 | B2 * | 4/2012 | Kato et al. | 704/268 |
| 2002/0032563 | A1 * | 3/2002 | Kamai et al. | 704/207 |
| 2004/0199383 | A1 * | 10/2004 | Kato et al. | 704/219 |
| 2005/0119890 | A1 * | 6/2005 | Hirose | 704/260 |
| 2005/0165608 | A1 * | 7/2005 | Suzuki et al. | 704/261 |
| 2009/0281807 | A1 | 11/2009 | Hirose et al. | |
| 2010/0004934 | A1 | 1/2010 | Hirose et al. | |

FOREIGN PATENT DOCUMENTS

| | | |
|---|---|---|
| JP | 2004-219757 | 8/2004 |
| JP | 3576800 | 10/2004 |
| JP | 4294724 | 7/2009 |
| WO | 2008/142836 | 11/2008 |
| WO | 2009/022454 | 2/2009 |

OTHER PUBLICATIONS

Takahiro Ohtsuka et al., "*Robust ARX-based Speech Analysis Method Taking Voicing Source Pulse Train into Account*", The Journal of the Acoustical Society of Japan, vol. 58, No. 7, 2002, pp. 386-397 and its partial English translation (p. 387, col. 1 line 13—col. 2 line 7 from bottom).

* cited by examiner

SPEECH ANALYZER AND SPEECH ANALYSIS METHOD

CROSS REFERENCE TO RELATED APPLICATION

This is a continuation application of PCT application No. PCT/JP2009/004673, filed on Sep. 17, 2009, designating the United States of America.

BACKGROUND OF THE INVENTION (1) Field of the Invention

The present invention relates to a speech analyzer and a speech analysis method which extract a vocal tract feature and a sound source feature by analyzing an input speech.

(2) Description of the Related Art

In recent years, the development of speech synthesis techniques has enabled generation of very high-quality synthesized speech.

However, the conventional use of such synthesized speech is still centered on uniform purposes, such as reading off news texts in announcer style.

Meanwhile, speech having distinctive features (synthesized speech highly representing personal speech or synthesized speech having a distinct prosody and voice quality, such as the speech style of a high-school girl or speech with a distinct intonation of the Kansai region in Japan) has started to be distributed as a kind of content. For example, there is a service for mobile phones, which uses a speech message by a celebrity as a ringtone. Thus, in pursuit of further amusement in interpersonal communication, a demand for creating distinct speech to be heard by the other party is expected to grow.

The method for speech synthesis is classified into two major methods. The first method is a waveform concatenation speech synthesis method in which appropriate speech elements are selected, so as to be concatenated, from a speech element database (DB) that is previously provided. The second method is an analysis-synthesis speech synthesis method in which speech is analyzed so as to generate synthesized speech based on analyzed parameters.

In terms of converting the voice quality of the above-mentioned synthesized speech in many different ways, in the waveform concatenation speech synthesis method, it is necessary to prepare the same number of the speech element DBs as necessary voice quality types, and to concatenate the speech elements while switching between the speech element DBs. Thus, it requires enormous costs to generate synthesized speech having various voice qualities.

On the other hand, in the analysis-synthesis speech synthesis method, the analyzed speech parameters are transformed. This allows conversion of the voice quality of the synthesized speech. Generally, a model known as a sound source vocal tract model is used for the parameter analysis.

However, it is assumed that various noises are mixed into input speech in real environment. Accordingly, it is necessary to take measures to the mixed noise. For example, as a method for suppressing noise, there is a technology disclosed in Patent Literature 1: Japanese Unexamined Patent Application Publication No. 2002-169599 (pages 3 to 4, FIG. 2).

FIG. 11 shows the structure of the noise suppressing method disclosed in Patent Literature 1.

The noise suppressing method according to Patent Literature 1 sets a gain smaller than the gain for each band in the noise frame, with regard to the band assumedly not to include speech component within a frame determined as a speech frame (or has small speech component), and aims to achieve high audibility by enhancing the band in the speech frame.

More specifically, the noise suppressing method in which the input signal is divided into frames per predetermined time period, the divided frame is divided into predetermined frequency bandwidths, and noise is suppressed for each of the divided bandwidth, includes determining a speech frame whether the frame is a noise frame or a speech frame, setting a band gain value for each band in each frame based on the result in the determining of a speech frame, and generating an output signal in which noise is suppressed by reconstructing the frame after the noise suppression for each band using the band gain value. In the determining of the band gain value, the band gain value is set such that a band gain value in the case where the frame which is subject to the determining is determined as a speech frame is smaller than a band gain value in the case where the frame which is subject to the determining is determined as a noise frame.

SUMMARY OF THE INVENTION

With the noise suppressing method according to Patent Literature 1, it is possible to suppressing the auditory influence of the noise by adjusting the gains for each of the bands. However, adjusting the gains for each of the bands causes distortion in the spectrum structure of speech, distorting the personal feature of the speech.

Furthermore, with the method according to Patent Literature 1, there is a problem that the influence of the noise cannot be fully suppressed when the noise is suddenly mixed.

The present invention aims to solve the conventional problems, and it is an object of the present invention to provide a speech analyzer capable of performing a highly precise analysis of speech even when there is a background noise as in an actual environment.

Conventionally, the vocal tract and sound source model in which the vocal tract and the sound source are modeled assumes a stationary sound source model. Consequently, the fine fluctuation of the vocal tract feature is processed as a correct analysis result. The inventors consider an assumption that the vocal tract is stationary, rather than non-stationary, is more reasonable, and assumes that the sound source fluctuates faster than the vocal tract. In accordance with this idea, the conventional vocal tract and sound source model extracts the temporal change due to the fluctuation of the speech or the position of analysis window. As a result, there is a problem that the fast movement that the vocal tract inherently does not have is considered as a vocal tract feature, and that the fast movement that is inherently in the sound source is removed from the sound source feature.

The inventors disclose a method for solving the influence caused by the fine fluctuation in Patent Literature: Japanese Patent No. 4294724. That is, by using the fact that the vocal tract is stationary allows removal of the influence of noise even when the noise is mixed to the input speech.

In order to achieve the above object, a speech analyzer according to an aspect of the present invention analyzes an input speech to extract a vocal tract feature and a sound source feature, the speech analyzer including: a vocal tract and sound source separating unit which separates the vocal tract feature and the sound source feature from the input speech, based on a speech generation model obtained by modeling a vocal tract system for a speech; a fundamental frequency stability calculating unit which calculates a temporal stability of a fundamental frequency of the input speech in the sound source feature, from the sound source feature separated by the vocal tract and sound source separating unit; a stable analyzed period extracting unit which extracts time information of a stable period of the sound source feature, based on the temporal stability of the fundamental frequency of the input speech in the sound source feature calculated by the fundamental frequency stability calculating unit; and a vocal tract feature interpolation unit which interpolates a vocal tract feature which is not included in the stable period of the sound source feature, using a vocal tract feature included in the stable period of the sound source feature extracted by the stable analyzed period extracting unit, from among the vocal tract feature separated by the vocal tract and sound source separating unit.

With this structure, the vocal tract feature is interpolated, based on the stable period in the sound source feature. As described above, it is assumed that the fluctuation in the sound source is faster than the same in the vocal tract. Thus, the sound source feature is more likely to be affected by the noise than the vocal tract feature. For this reason, using the sound source feature allows a highly precise separation of the noise period and the non-noise period. Accordingly, it is possible to extract the vocal tract feature at high precision by interpolating the vocal tract feature based on the stable period in the sound source feature.

Preferably, the speech analyzer further includes a pitch mark assigning unit which extracts feature points which repeatedly appear at an interval of a fundamental period of the input speech, from the sound source feature separated by the vocal tract and sound source separating unit, and to assign pitch marks to the extracted feature points, in which the fundamental frequency stability calculating unit calculates the fundamental frequency of the input speech in the sound source feature, using the pitch marks assigned by the pitch mark assigning unit and to calculate the temporal stability of the fundamental frequency of the input speech in the sound source feature, using the calculated fundamental frequency.

Preferably, the pitch mark assigning unit extracts a glottal closing point from the sound source feature separated by the vocal tract and sound source separating unit, and assigns the pitch mark to the extracted glottal closing point.

The sound source feature waveform is characterized by a sharp peak in the glottal closing point. On the other hand, the waveform of the sound source feature in the noise period shows sharp peaks in multiple points. Accordingly, using the glottal closing point as the feature point assigns the pitch marks at a constant interval in the non-noise period, whereas the pitch marks are randomly assigned in the noise period. Utilizing this property allows a highly precise separation of the stable period and non-stable period in the sound source feature at high precision.

More preferably, the speech analyzer further includes a sound source feature reconstructing unit which reconstructs a sound source feature in a period other than the stable period of the sound source feature, using the sound source feature included in the stable period of the sound source feature extracted by the stable analyzed period extracting unit, from among the sound source feature separated by the vocal tract and sound source separating unit.

This structure reconstructs the sound source feature, based on the stable period in the sound source feature. As described above, it is assumed that the variation in the sound source is faster than the same in the vocal tract. Thus, the sound source feature is more likely to be affected by the noise. For this reason, using the sound source feature allows the highly precise separation of the noise period and the non-noise period. Therefore, it is possible to extract the sound source feature at high precision by reconstructing the sound source feature based on the stable period in the sound source feature.

More preferably, the speech analyzer further includes: a reproducibility calculating unit which calculates a reproducibility of the vocal tract feature interpolated by the vocal tract feature interpolation unit; and a re-input instruction unit instructs a user to re-input the speech when the reproducibility calculated by the reproducibility calculating unit is smaller than a predetermined threshold.

When the high-precision analysis of the vocal tract feature cannot be performed due to large effect of the noise, it is possible to extract the vocal tract feature and the sound source feature unsusceptible to the noise.

Note that, the present invention is not only implemented as a speech analyzer including the characteristic processing units, but also as a speech analysis method having the characteristic processing units included in the speech analyzer as steps, and as a program causing a computer to execute the characteristic steps included in the speech analysis method. Needless to say, such a program can be distributed via recording media such as Compact Disc-Read Only Memory (CD-ROM) and communication networks such as the Internet.

The speech analyzer according to the present invention can interpolate the vocal tract feature and the sound source feature included in the noise period based on the stable period in the sound source feature, even when the noise is mixed into the input speech.

As described above, using the vocal tract feature and the sound source feature included in the partially correctly analyzed period allows reconstruction of the vocal tract feature and the sound source feature included in another period. For this reason, even when the noise is suddenly mixed into the input speech, it is possible to analyze the vocal tract feature and the sound source feature which are personal feature of the input speech at high precision and without the effect of noise.

Further Information about Technical Background to this Application

The disclosure of Japanese Patent Application No. 2008-248536 filed on Sep. 26, 2008 including specification, drawings and claims is incorporated herein by reference in its entirety.

The disclosure of PCT application No. PCT/JP2009/004673 filed on Sep. 17, 2009, including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENTS

The following describes an embodiment of the present invention with reference to the drawings.

Figure 1:
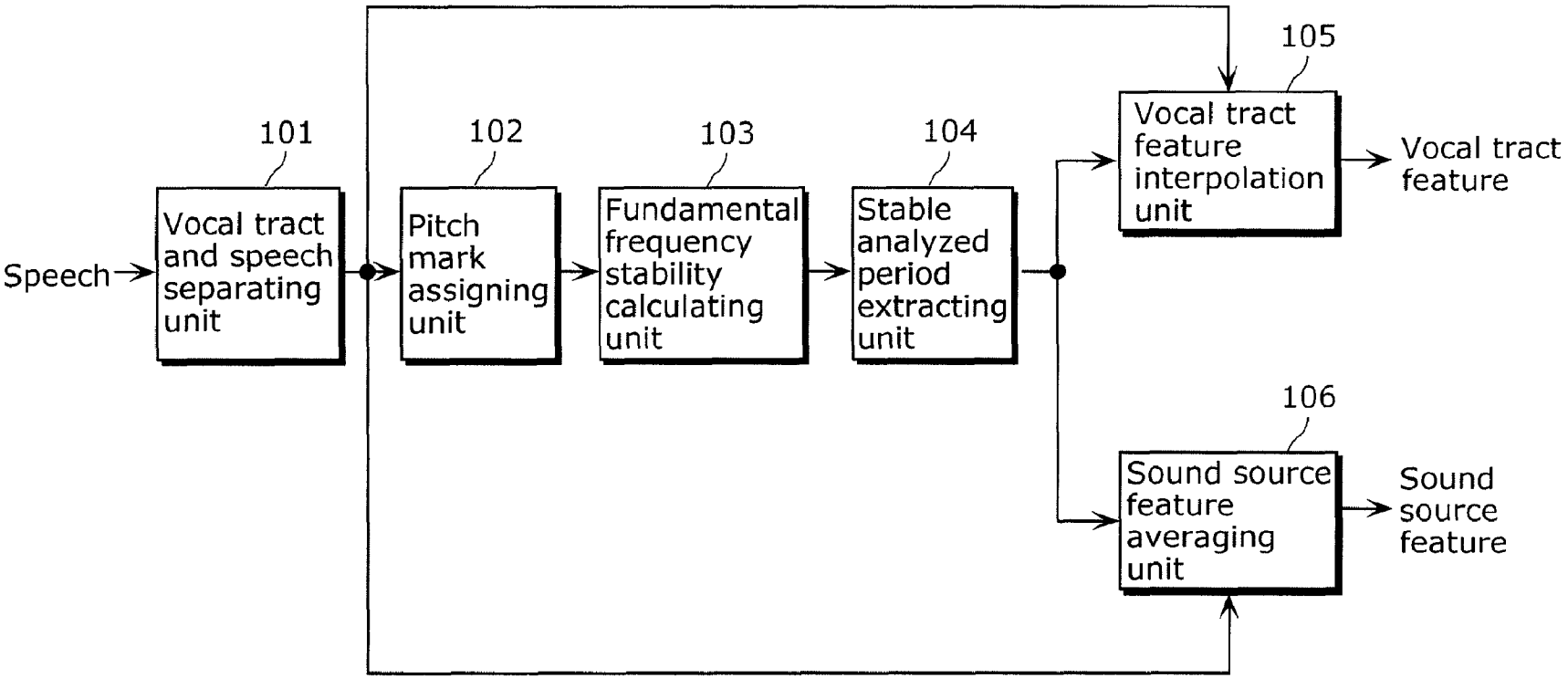
FIG. 1 is a block diagram showing functional structure of the speech analyzer according to an embodiment of the present invention.

FIG. 1 is a block diagram showing a functional structure of the speech analyzer according to the embodiment of the present invention.

The speech analyzer is a device which separates a vocal tract feature and a sound source feature from an input speech, and includes a vocal tract and sound source separating unit 101, a pitch mark assigning unit 102, a fundamental frequency stability calculating unit 103, a stable analyzed period extracting unit 104, a vocal tract feature interpolation unit 105, and a sound source feature averaging unit 106.

Note that, the speech analyzer according to this embodiment is implemented by a regular computer including a CPU and a memory. That is, the speech analyzer is implemented by executing a program for implementing each of the components on the CPU, and storing the intermediate data in the program and the process in the memory.

The vocal tract and sound source separating unit 101 is a processing unit which separates the vocal tract feature and the sound source feature from the input speech based on the speech generating model modeling a vocal tract system for speech.

The pitch mark assigning unit 102 is a processing unit which extracts feature points that repeatedly appear in a fundamental periodic interval of the input speech and which assigns a pitch mark to the extracted feature points.

The fundamental frequency stability calculating unit 103 calculates a fundamental frequency of the input speech in the sound source feature, using the pitch mark assigned by the pitch mark assigning unit 102, and calculates the temporal stability of the fundamental frequency of the input speech in the sound source feature, using the calculated fundamental frequency.

The stable analyzed period extracting unit 104 is a processing unit which extracts the stable period in the sound source feature based on the temporal stability of the fundamental frequency of the input speech in the sound source feature calculated by the fundamental frequency stability calculating unit 103.

The vocal tract feature interpolation unit 105 is a processing unit which interpolates the vocal tract feature not included in the stable period in the sound source feature using the vocal tract feature included in the stable period in the sound source feature extracted by the stable analyzed period extracting unit 104, from among the vocal tract feature separated by the vocal tract and sound source separating unit 101.

The sound source feature averaging unit 106 is a processing unit which calculates an average value of the sound source feature included in the stable period in the sound source feature extracted by the stable analyzed period extracting unit 104, from among the sound source feature separated by the vocal tract and sound source separating unit 101, and determines the calculated average value of the sound source feature as the sound source feature of the periods other than the stable periods of the sound source feature.

The following specifically describes each component.

<Vocal Tract and Sound Source Separating Unit 101>

The vocal tract and sound source separating unit 101 separates the vocal tract feature and the sound source feature from the input speech, using the vocal tract and sound source model modeling the vocal tract and the sound source (the speech generating model modeling the vocal tract system of speech). There is no restriction on the vocal tract and sound source model used for the separation, and can be any model.

For example, when the linear prediction coding model (the LPC model) is used as the vocal tract and sound source model, the sample value s (n) is predicted using p previous sample values. The sample value s (n) can be represented as in the equation 1.

[Math 1]

$$s(n) \cong \alpha_1 s(n-1) + \alpha_2 s(n-2) + \alpha_3 s(n-3) + \Lambda + \alpha_p s(n-p) \quad \text{(Equation 1)}$$

The coefficient $\alpha i$ for the p sample values can be calculated by using the correlation method or the covariance method. The input speech signal can be generated by the equation 2 using the calculated coefficient $\alpha i$.

[Math 2]

$$S(z) = \frac{1}{A(z)} U(z) \quad \text{(Equation 2)}$$

Here, S (z) denotes a value of the speech signal s (n) after z transformation. U (z) is a z transformed value of the voiced sound source signal u (n), and denotes the inverse-filtered signal of the input speech S (z) using the vocal tract feature 1/A (z).

Usually, when analyzing speech, it is assumed that the speech is stationary in the analysis window. More specifically, the vocal tract feature is assumed to be stationary in the analysis window. Accordingly, when the noise is multiplexed on the input speech, the stationary noise assumedly affects the vocal tract feature.

On the other hand, the sound source feature is obtained by filtering the speech by a filter having an inverse property to the vocal tract feature analyzed as described above. Therefore, when the noise is multiplexed on the input speech, the non-stationary noise component is included in the sound source feature.

Thus, when the analysis fails due to the non-stationary noise, it is difficult to detect the noise period from the vocal tract feature in the analysis period, and it is necessary to determine the noise period by the sound source feature.

The vocal tract and sound source separating unit 101 may also calculate the PARCOR coefficient (PARtial auto CORrelation coefficient) ki, using the linear predictive coefficient $\alpha i$ analyzed by the LPC analysis. The PARCOR coefficient is known to have a better interpolation property than the linear predictive coefficient. The PARCOR coefficient can be calculated using the Levinson-Durbin-Itakura algorithm. Note that, the PARCOR coefficient includes the following two features.

(Feature 1) Lower order coefficients have larger influence on the spectrum caused by its variation, and the influence of the fluctuation becomes smaller as the order of the coefficient becomes higher.

(Feature 2) The influence on the fluctuation the higher coefficient flatly ranges the entire area.

The following description uses the PARCOR coefficient as the vocal tract feature. Note that, the vocal tract feature to be used is not limited to the PARCOR coefficient, but the linear predictive coefficient may be used as well. Furthermore, the Line Spectrum Pair (LSP) may be used as well.

Furthermore, the vocal tract and sound source separating unit 101 can separate the vocal tract and the sound source using the Autoregressive with exogenous input (ARX) analysis, when the ARX model is used as the vocal tract and sound source model. The ARX analysis is significantly different from the LPC analysis in that the mathematical sound source model is used as the sound source. Furthermore, in the ARX analysis, in contrast with the LPC analysis, it is possible to separate the information of the vocal tract and the information of the sound source more precisely, even when the analysis period includes plural fundamental periods (Non-Patent Literature 1: Otsuka and Kasuya, "Robust ARX-based speech analysis method taking voicing source pulse train into account" The Journal of the Acoustical Society of Japan 58(7), 2002, pp. 386-397).

In the ARX analysis, the speech is generated through the process shown in Equation 3. In Equation 3, S (z) represents a z-transformed value of the speech signal s (n). U (z) represents a z-transformed value of the voiced sound source signal u (n). E (z) represents a z-transformed value of the voiceless noise sound source e (n). In other words, in the ARX analysis, the voiced sound is generated by the first term in Equation 3, and the voiceless sound is generated by the second term in Equation 3.

[Math 3]

$$S(z) = \frac{1}{A(z)}U(z) + \frac{1}{A(z)}E(z) \qquad \text{(Equation 3)}$$

Here, as the model for the voiced sound source signal u (t)=u (nTs), the sound model indicated in Equation 4 is used. Here, Ts indicates a period for sampling.

[Math 4]

$$u(t) = \begin{cases} 2a(t - OQ \times T0) - 3b(t - OQ \times T0)^2, & -OQ \times T0 < t \leq 0 \\ 0, & \text{elsewhere} \end{cases} \qquad \text{(Equation 4)}$$

$$a = \frac{27AV}{4OQ^2T0},$$

$$b = \frac{27AV}{4OQ^3T0^2}$$

Note that AV denotes amplitude of voicing, T0 denotes fundamental period, and OQ denotes open quotient. Nominal 1 in Equation 4 is used for the voiced sound, and nominal 2 in Equation 4 is used for the voiceless sound. The open quotient OQ represents an opening ratio of glottis in one fundamental period. A tendency is known where the larger the value of open quotient OQ, the softer the speech.

The following is the advantages of the ARX analysis compared to the LPC analysis.

(Advantage 1) Since analysis is performed by arranging a series of sound source pulses corresponding to the fundamental periods in the analysis window, the vocal tract information of high-pitched voice such as female voices or children's voice can be stably analyzed.

(Advantage 2) The ARX analysis has particularly high vocal tract and sound source separating function for narrow vowels such as /i/ and /u/ in which the fundamental frequency F0 and the first formant frequency (F1) are close.

In the voiced sound period, in the same manner as the LPC analysis, U (z) can be calculated by inverse-filtering of the input speech S (z) using the vocal tract feature 1/A (z).

In the ARX analysis, the format of the vocal tract feature 1/A (z) is the same as the system function in the LPC analysis. Accordingly, the vocal tract and sound source separating unit 101 may transform the vocal tract feature into a PARCOR coefficient, using a method same as the LPC analysis.

<Pitch Mark Assigning Unit 102>

The pitch mark assigning unit 102 assigns a pitch mark to the voiced period of the sound feature separated by the vocal tract and sound source separating unit 101.

The pitch mark refers to the marks assigned to feature points that repeatedly appear in an interval of the fundamental frequency of the input speech. The peak positions of the power of the speech waveform, and the positions of the glottal closing points are the positions of the feature points to which the pitch marks are assigned.

Figure 2:
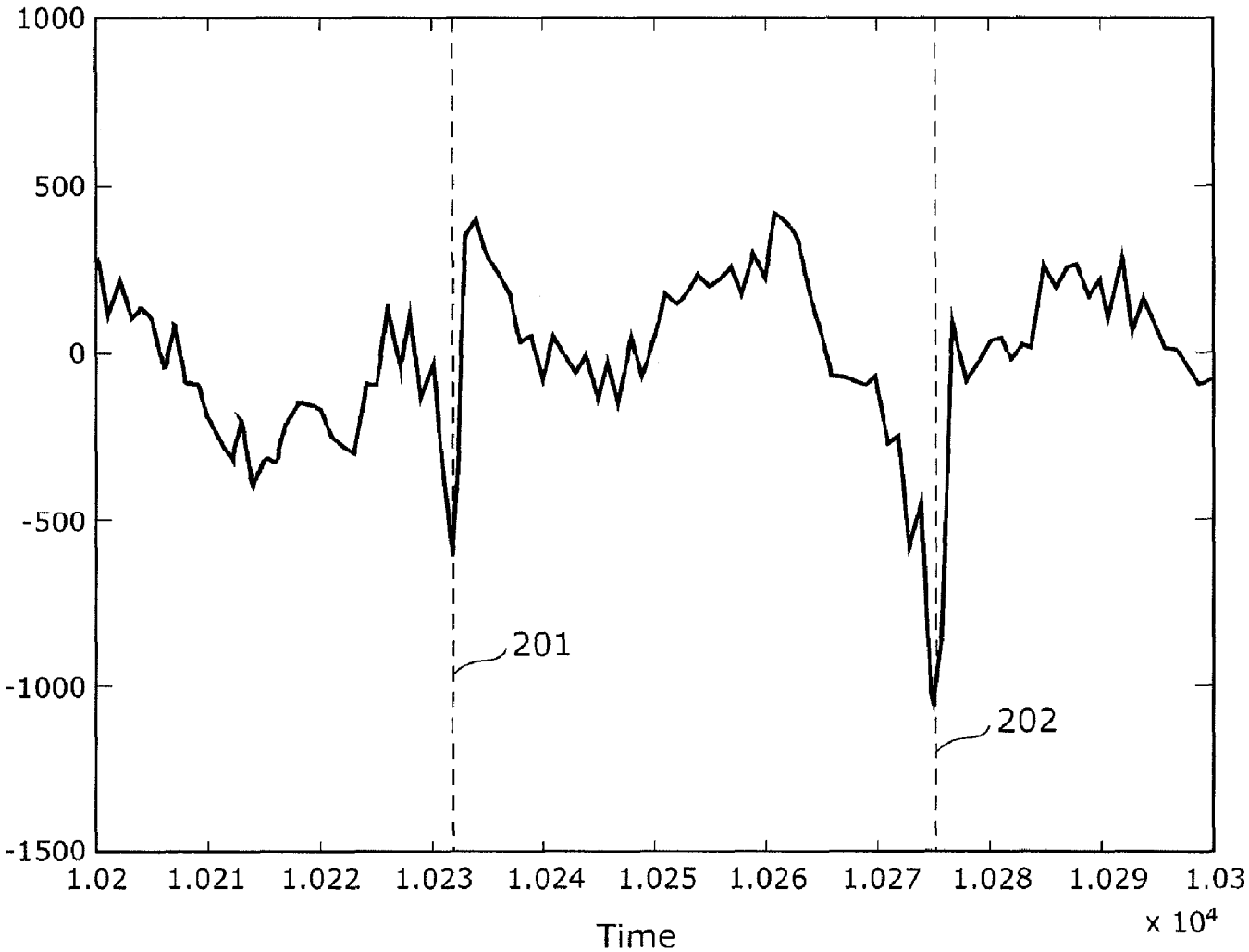
FIG. 2 shows an example of sound source waveform.

For example, when the vocal tract feature and the sound source feature are separated by the above-described ARX model, the sound source waveform as shown in FIG. 2 can be obtained as the sound source feature. In FIG. 2, the horizontal axis represents time, and the vertical axis represents amplitude. In this waveform, the glottal closing point corresponds to the peaks of the sound source waveform at the time 201 and 202. The pitch mark assigning unit 102 assigns pitch marks to these points. The sound source waveform is generated through opening and closing of the vocal chord, the glottal closing point indicates the moment when the vocal chord closes, and has a characteristic sharp peak.

Furthermore, there is another method in which the pitch mark is assigned at a peak position of the fundamental wave. As a specific example for calculating the peak position of the fundamental wave includes a method in which the fundamental wave is extracted from the speech waveform using an adaptive low-pass filter, and detects the peak position. Patent Literature: Japanese Patent No. 3576800 discloses this method.

In the present invention, there is no restriction on the method for assigning pitch mark, including the method described above.

<Fundamental Frequency Stability Calculating Unit 103>

As described above, when the noise is added to the input speech, non-stationary noise among the noise affects the sound source information. Accordingly, the fundamental frequency stability calculating unit 103 calculates the stability of the fundamental frequency, in order to detect the effect of the non-stationary noise to the sound source feature.

The fundamental frequency stability calculating unit 103 calculates the stability of the fundamental frequency of the input speech in the sound source feature separated by the vocal tract and sound source separating unit 101 (hereinafter referred to as "F0 stability"), using the pitch mark assigned by the pitch mark assigning unit 102. Although the calculation method for F0 stability is not particularly limited, the F0 stability can be calculated using the method shown below, for example.

Figure 3:
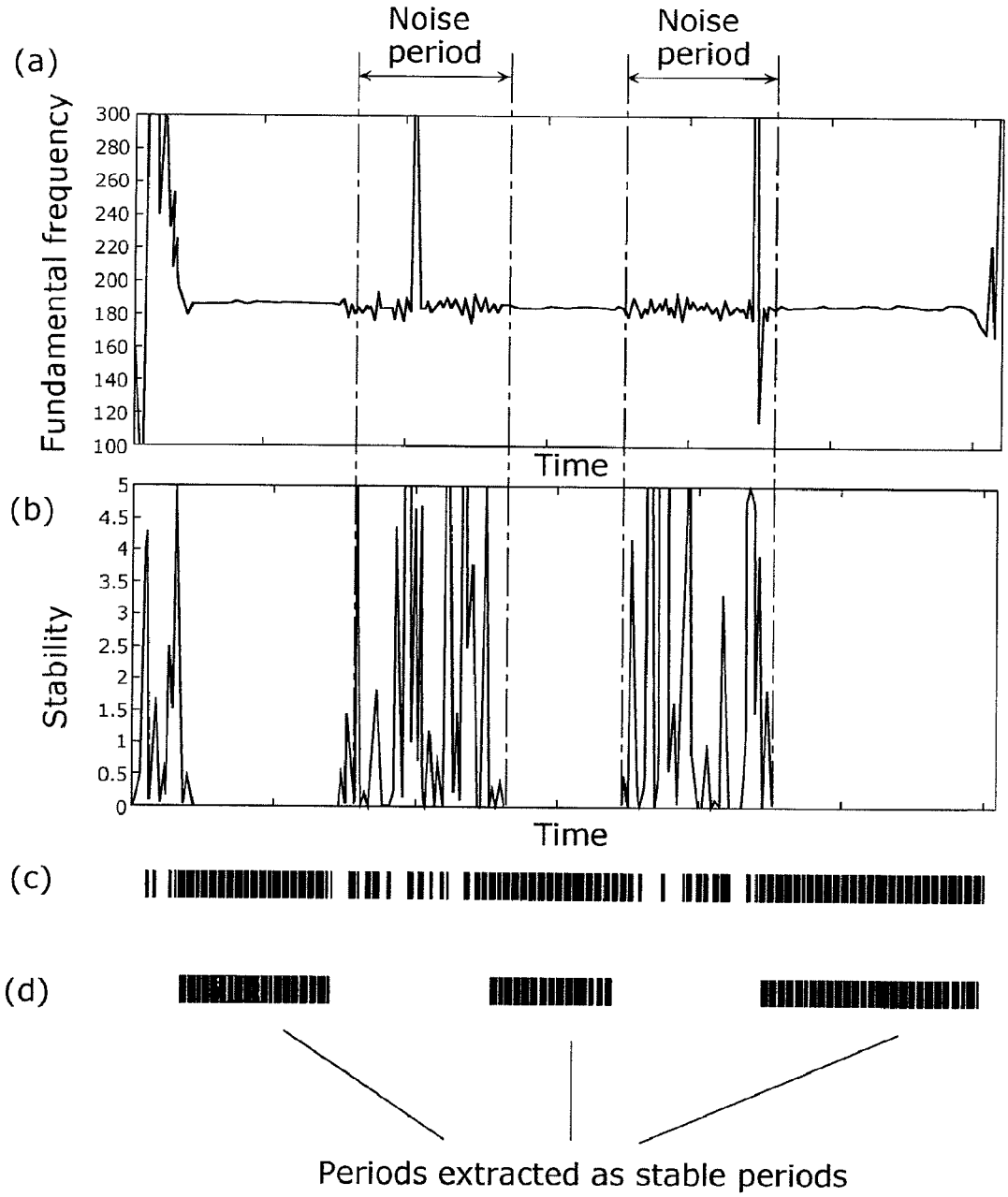
FIG. 3 is a diagram for describing extraction of a stable period by a stable analyzed period extraction unit.

First, the fundamental frequency stability calculating unit 103 calculates the fundamental frequency (F0) of the input speech using the pitch mark. In the example of the sound source waveform shown in FIG. 2, the time from time 202 to 201 (that is, a time period between adjacent pitch marks) corresponds to the fundamental period of the input speech, and the reciprocal of the fundamental period corresponds to the fundamental frequency of the input speech. For example, FIG. 3(*a*) is a chart showing the value of the fundamental frequency F0, and the horizontal axis represents time, and the vertical axis represents the value of fundamental frequency F0. As shown in FIG. 3, the value of the fundamental frequency F0 varies in the noise period.

Next, the fundamental frequency stability calculating unit 103 calculates the F0 stability STi for each analysis frame i per predetermined time. The F0 stability STi is indicated by Equation 5, and can be represented as the deviation from the average in the phoneme period. Note that, smaller value of the F0 stability STi indicates more stable values of the fundamental frequency F0, and larger value indicates larger variation in the values of the fundamental frequency F0.

[Math 5]

$$ST_i=(F0_i-\overline{F0})^2 \quad \text{(Equation 5)}$$

Note that

[Math 6]

$\overline{F0}$ represents the average of F0 within the phoneme including the analysis frame i.

Note that, the method for calculating the F0 stability is not limited to this method. For example, strength in periodicity can be determined by calculating the autocorrelation function. For example, the value of the autocorrelation function $\phi$ (n) shown in Equation 6 is calculated with respect to the sound source waveform s (n) in the analysis frame. A correlation value $\phi$ (T0) in a position deviated away from the point for the fundamental period T0 is calculated using the calculated $\phi$ (n). The magnitude of the calculated correlation value $\phi$ (T0) indicates the strength of the periodicity. Accordingly, the correlation value may be calculated as the F0 stability.

[Math 7]

$$\phi(n)=\sum_{k=0}^{N} s(k-n)*s(k) \quad \text{(Equation 6)}$$

For example, FIG. 3(*b*) indicates the F0 stability in each pitch mark. The horizontal axis indicates time, and the vertical axis indicates the values of the F0 stability. As shown in FIG. 3(*b*), the F0 stability increases in the noise periods.

<Stable Analyzed Period Extracting Unit 104>

The stable analyzed period extracting unit 104 extracts a period where the stable analysis of the sound source feature is performed based on the F0 stability in the sound source feature calculated by the fundamental frequency stability calculating unit 103. There is no particular restriction on the extraction method. For example, the extraction can be performed through the following process.

For example, the stable analyzed period extracting unit 104 determines the period where the analysis frames in which the F0 stability calculated by Equation 5 is smaller than the predetermined threshold, as a period where the sound source feature is stable. In other words, the stable analyzed period extracting unit 104 extracts a period where Equation 7 is satisfied as the stable period. For example, the periods represented in black rectangles in FIG. 3(*c*) are the stable periods.

[Math 8]

$$ST_i<Tresh \quad \text{(Equation 7)}$$

Furthermore, the stable analyzed period extracting unit 104 may extract the stable period such that the time where the stable period continues is equal to or longer than the predetermined time period (for example, 100 msec). This process can exclude micro stable periods (stable periods with short continuous time. For example, as shown in FIG. 3(*d*), it is possible to exclude the short stable periods that intermittently appeared in FIG. 3(*c*), and continuous long periods are extracted.

When the F0 stability is calculated using deviation from the average value, time variability of deviation is not considered. Thus, the value around the average value may be calculated by accident. However, in such a case, the fundamental frequency F0 does not stably remain at the average value for a long time. For this reason, it is preferable that such a period is excluded from the stable period. Excluding the micro period allows the subsequent use of the periods in which the sound source feature is more stably analyzed.

Furthermore, the stable analyzed period extracting unit 104 also obtains the time period corresponding to the extracted stable period (hereinafter referred to as "time information of the stable period").

Note that, when separating the vocal tract feature and the sound source feature by the ARX analysis, the Rosenberg-Klatt model is used as the model for the vocal chord sound source waveform. Accordingly, it is preferable that the model sound source waveform and the inverse filter sound source waveform match. Therefore, it is highly likely that the analysis is not successful when the fundamental frequency identical to the assumed model sound source waveform and the fundamental frequency having the glottal closing point of the inversely filtered sound source waveform as a reference are divergent. Thus, in such a case, it is determined that the analysis is not stably performed.

<Vocal Tract Feature Interpolation Unit 105>

The vocal tract feature interpolation unit 105 interpolates the vocal tract feature using the vocal tract information corresponding to the time information of the stable period extracted by the stable analyzed period extracting unit 104 from among the vocal tract feature separated by the vocal tract and sound source separating unit 101.

The sound source information along the vibration of the vocal chord can vary at a time interval close to the fundamental frequency of the speech (tens of Hz to hundreds of Hz). The vocal tract information which represents the shape of the vocal tract from the vocal chord to lips is assumed to change in a time interval near the speed of speech (for example, 6 mora/second in a conversational tone). Accordingly, the change in the vocal tract information is temporally moderate, allowing the interpolation.

One of the features of the present invention is to interpolate the vocal tract feature using the time information of the stable period extracted from the sound source feature. It is difficult to obtain stable time information of the vocal tract feature merely from the vocal tract feature, and it is unknown which period is a period with successful analysis at high precision. This is because, in the case of the vocal tract and sound source model, effect of model mismatch due to noise is likely to be added to the sound source information more. The vocal tract information is averaged in the analysis window. Accordingly, the analysis cannot be determined based merely on the continuity of the vocal tract information, and even if the vocal tract information is continuous to some extent, that does not necessarily suggest a stable analysis. On the other hand, the sound source information has an inverse filter waveform using the vocal tract information. Accordingly, the information is in short time unit than the vocal tract information. For this reason, the effect due to the noise is likely to be detected.

Accordingly, using the stable period extracted from the sound source feature allows obtaining the partially appropriately analyzed period. With this, with regard to the vocal tract feature, it is possible to reconstruct the vocal tract feature other than the stable period using the obtained time information of the stable period. For this reason, even when the noise is suddenly mixed to the input speech, it is possible to highly precisely analyze the vocal tract feature and the sound source feature which are personal features of the input speech without the effect of noise.

Next, the following describes the specific example of a method for interpolating the vocal tract feature.

The vocal tract feature interpolation unit 105 interpolates, in the temporal direction and for each dimension, the PARCOR coefficients calculated by the vocal tract and sound source separating unit 101, using the PARCOR coefficient in the stable period extracted by the stable analyzed period extracting unit 104.

Although there is no particular restriction on the method for interpolation, smoothing can be performed by approximating each dimension using polynomial as shown in Equation 8.

[Math 9]

$$\hat{y}_a = \sum_{i=0}^{p} a_i x^i \quad \text{(Equation 8)}$$

Here,

[Math 10]

$\hat{y}_a$ denotes the PARCOR coefficient approximated by the polynomial, $a_i$ denotes the coefficient of the polynomial, and x denotes time.

Here, using only the vocal tract information at the time included in the stable period extracted by the stable analyzed period extracting unit 104 as x allows removal of the effect of the noise.

Furthermore, as the duration in which the approximation is applied, one phoneme period can be used as a unit for the approximation, for example, considering that the vocal tract feature for each vowel is as the personal feature. The time width is not limited to the phoneme period, but the time width may be from the center of the phoneme to the center of next phoneme. Note that the following description shall be made using the phoneme period as a unit for approximation.

Figure 4:
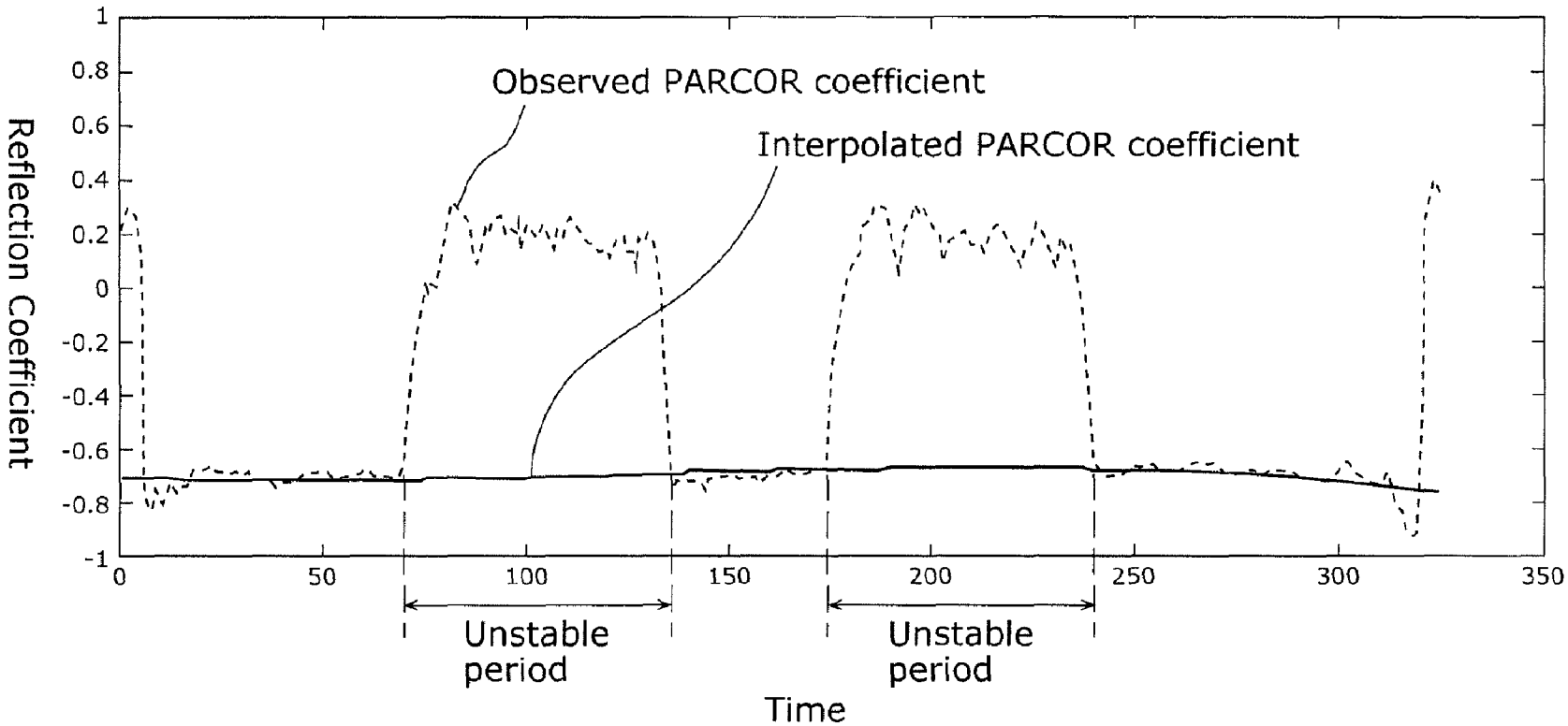
FIG. 4 is a diagram for describing interpolation process for the vocal tract feature by the vocal tract feature interpolation unit.

FIG. 4 is a chart showing a primary PARCOR coefficient when interpolating the PARCOR coefficient using the quintic polynomial approximation in a temporal direction per phoneme. The horizontal axis of the chart represents time, and the vertical axis represents the value of PARCOR coefficient. The broken line indicates the vocal tract information (PARCOR coefficient) separated by the vocal tract and sound source separating unit 101, and the solid line indicates the vocal tract information (PARCOR coefficient) in which the vocal tract information outside the stable period is interpolated.

Although quintic polynomial is used as an example in this embodiment, the order of the polynomial may not be quintic. Note that, other than the approximation using polynomials, the interpolation using moving average may be performed. Furthermore, an interpolation using straight line or an interpolation using the spline curve may be performed as well.

FIG. 4 indicates that the PARCOR coefficients in the unstable periods are interpolated. FIG. 4 also indicates that the PARCOR coefficients are smoothed, and it is more leveled.

Note that, it is possible to prevent the discontinuity of the PARCOR coefficient at the boundary of the phonemes by setting an appropriate transition period, and performing linear interpolation of the PARCOR coefficient using the PARCOR coefficient before and after the transition period.

When the label information is assigned to the input speech, it is preferable to use "phoneme" as a unit for interpolation. "Mora" or "syllable" may also be used as a unit as well. Alternatively, when there are successive the vowels, two successive vowels may be a unit for interpolation.

On the other hand, when the label information is not assigned, the vocal tract feature may be interpolated with a time width of a predetermined length (for example, tens of msec to hundreds of msec such that the time width is approximately equal to the length of one phoneme).

<Sound Source Feature Averaging Unit 106>

The sound source feature averaging unit 106 averages the sound source feature included in the stable period extracted by the stable analyzed period extracting unit 104, from among the sound source feature separated by the vocal tract and sound source separating unit 101.

The following describes the specific example of averaging.

For example, the sound source feature such as the fundamental frequency, the open quotient, and the non-periodic component are less likely to be affected by phonemes, compared to the vocal tract feature. Thus, averaging the various sound source features in the stable period extracted by the stable analyzed period extracting unit 104 allows representation of the personal sound source feature by an average value.

For example, regarding the fundamental frequency, the fundamental frequency of the stable period extracted by the stable analyzed period extracting unit 104 can be used as the average fundamental frequency of the speaker.

Similarly, regarding the open quotient and the non-periodic component, the open quotient and the non-periodic component in the stable period extracted by the stable analyzed period extracting unit 104 can be used as the average open quotient and the average non-periodic component of the speaker as well.

As described above, excluding the period in which the accuracy of analysis is deteriorated due to the environmental noise and performing averaging allow a stable extraction of the sound source feature of the speaker.

Note that, not only the average value of each of the sound source features, but variance value can be included to the personal features for use as well. Using the variance value allows control of the magnitude of temporal variation. This is effective for raising the reproducibility of the personal feature.

Furthermore, instead of averaging, the value of the unstable period may be calculated using the value of the stable period in the sound source feature (such as the fundamental frequency, the open quotient, and the non-periodic component) in the same manner as the vocal tract feature interpolation unit 105.

<Flowchart>

Figure 5:
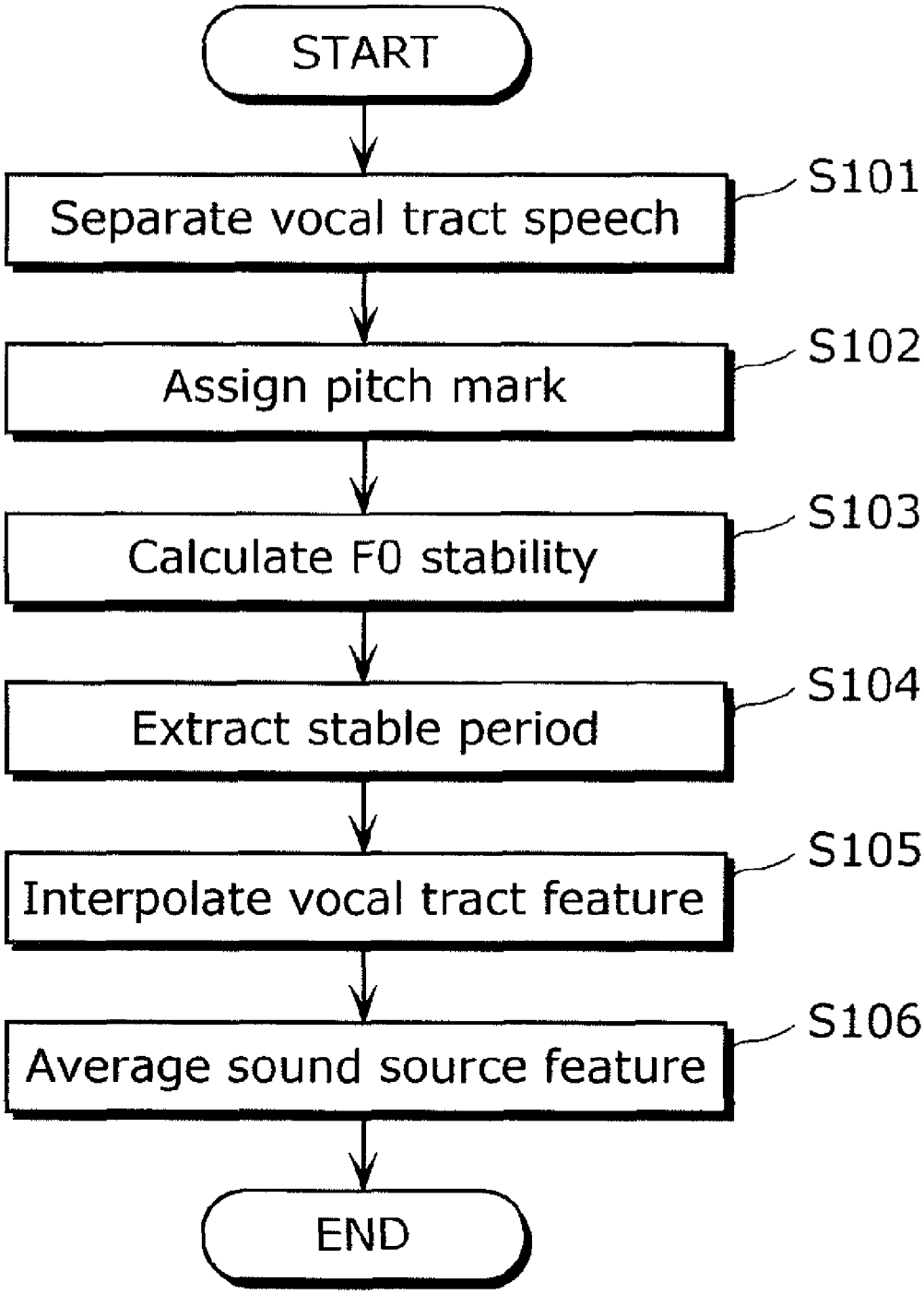
FIG. 5 is a flowchart showing the operations of the speech analyzer according to the embodiment of the present invention.

The following describes a detailed procedure of the operations based on the flowchart indicated in FIG. 5.

Figure 6:
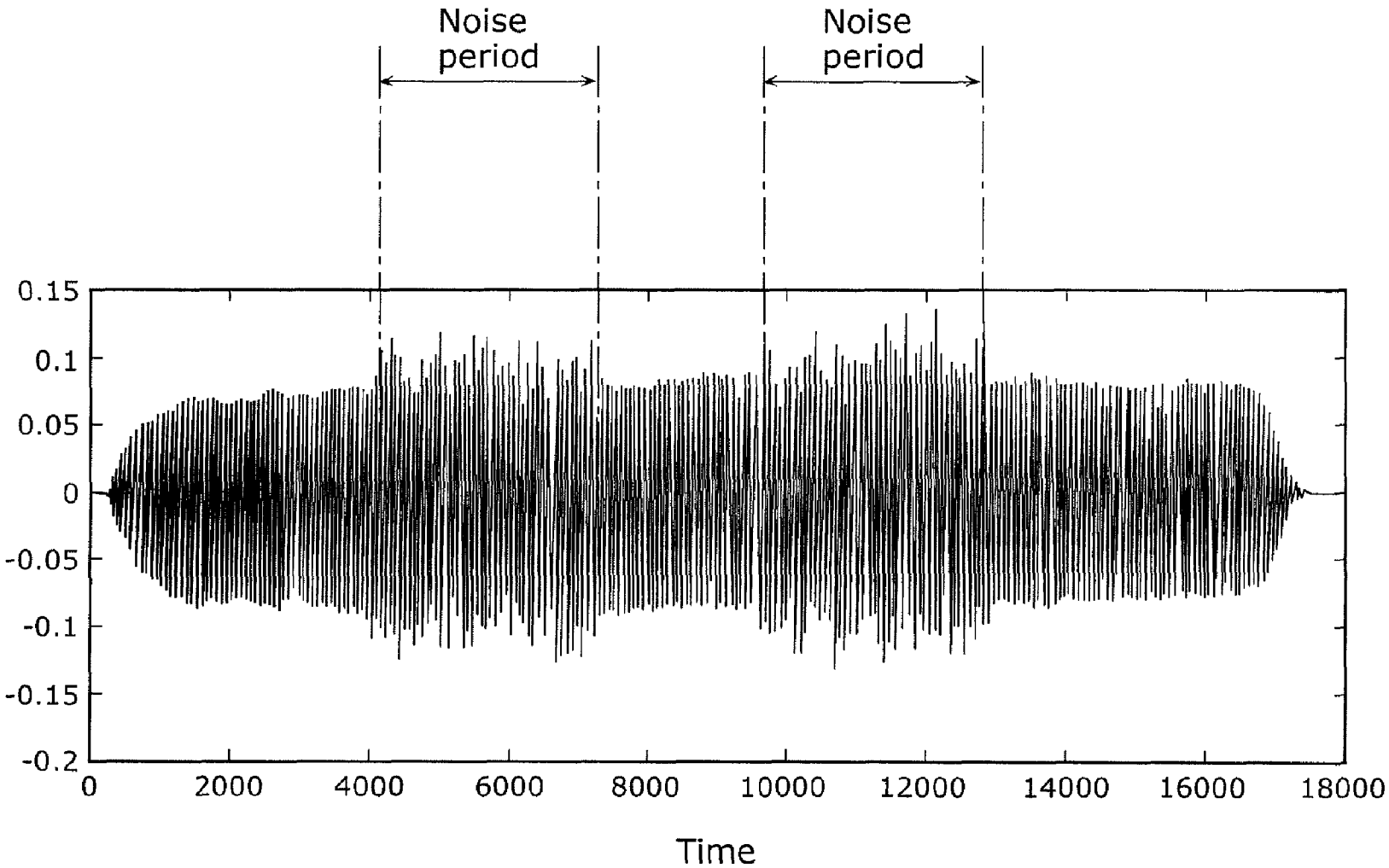
FIG. 6 shows an example of input speech waveform.

The vocal tract and sound source separating unit 101 separates the vocal tract feature and the sound source feature from the input speech (step S101). The following is an example in which the speech indicated in FIG. 6 is input. As shown in FIG. 6, the sporadic noise is mixed during the utterance of a vowel /o/.

Although there is no particular restriction on the method for separating the vocal tract and sound source, the vocal tract feature and the sound source feature can be separated using the speech analysis method using the linear prediction model or the ARX model.

Figure 7:
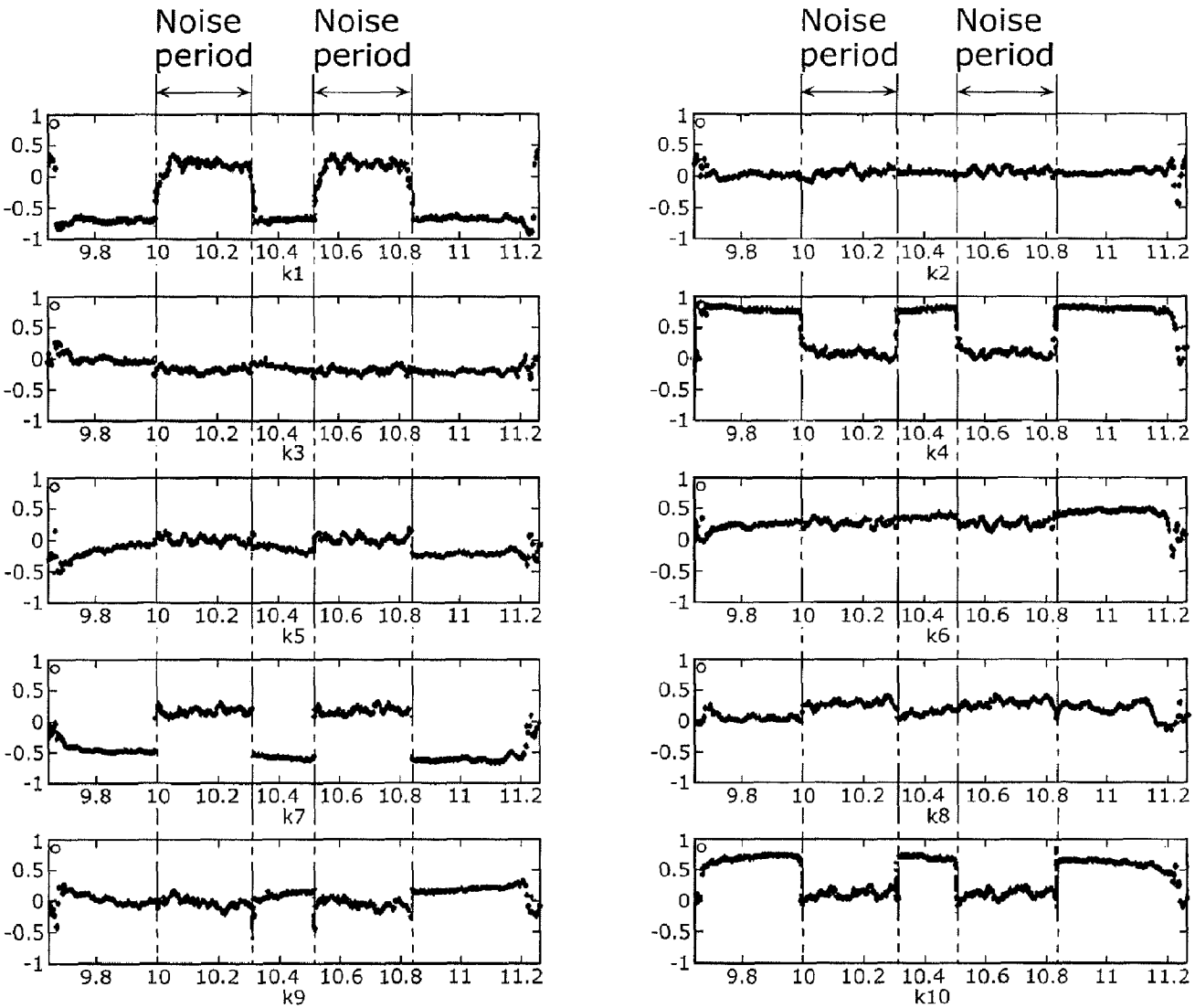
FIG. 7 shows an example of vocal tract feature using the PARCOR coefficient.

In the following description, the separation is carried out using the ARX model. FIG. 7 indicates the vocal tract feature in PARCOR coefficient, separated from the speech shown in FIG. 6, by the separation using the ARX model. Here, each of the decenary PARCOR coefficients is indicated. FIG. 7 indicates that the PARCOR coefficients in the noise periods are distorted compared to the periods other than the noise periods. The degree of distortion depends on the power of the background noise.

Figure 8A:
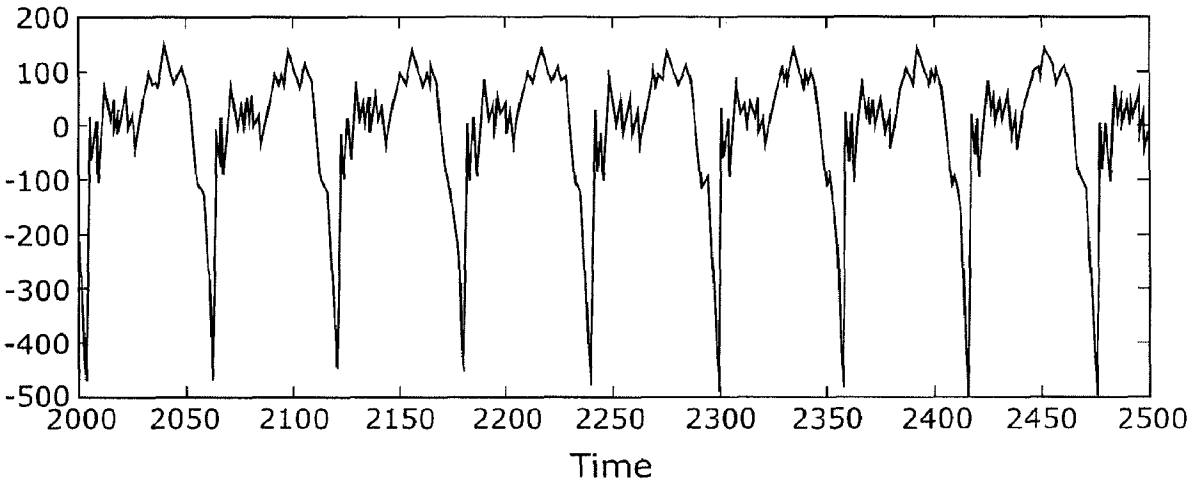
FIG. 8A shows an example of sound source waveform where no noise is detected.
Figure 8B:
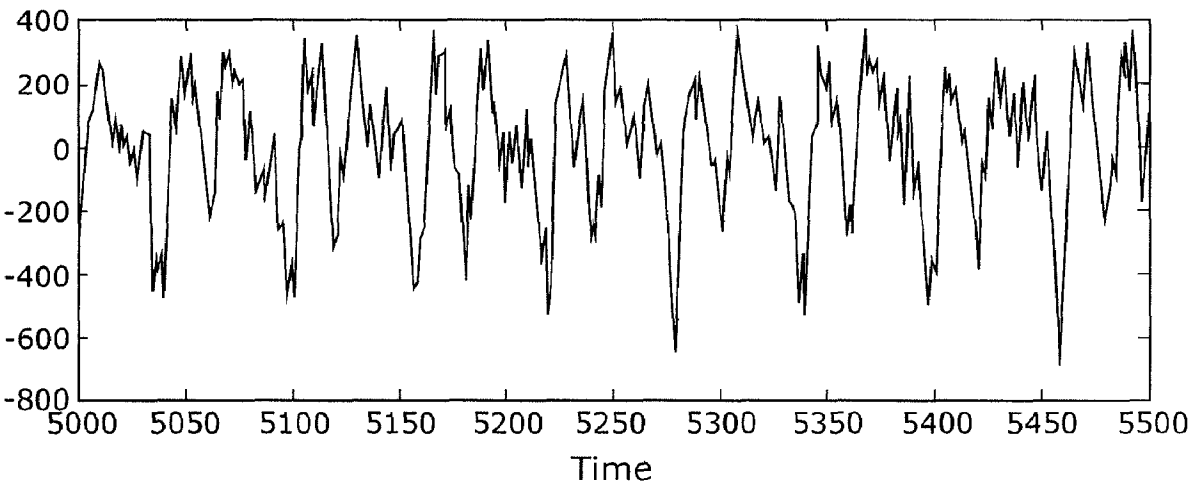
FIG. 8B shows an example of speech waveform in the noise period.

The pitch mark assigning unit 102 extracts the feature point based on the sound source feature separated by the vocal tract and sound source separating unit 101, and assigns a pitch mark to the extracted feature point (step S102). More specifically, the glottal closing point is detected from the sound source waveform shown in FIGS. 8A and 8B, and the pitch mark is assigned to the glottal closing point. FIG. 8A shows the sound source waveform in a period without noise, and FIG. 8B shows the sound source waveform in the noise period. As described above, the effect due to the noise appears on the sound source waveform after the separation of vocal tract and sound source. That is, due to the effect of the noise, a sharp peak that inherently appears on the glottal closing point does not appear, or a sharp peak appears on a point other than the glottal closing point. This affects the position of pitch mark.

The calculation method of the glottal closing point is not particularly restricted. For example, low-pass filtering is performed on the sound source waveform shown in FIG. 8A or 8B, and the peak points protruding downward may be calculated (For example, see Patent Literature Japanese Patent No. 3576800) after the removal of fine vibration components.

Even when the method disclosed in Japanese Patent No. 3576800 is used as the method for assigning the pitch mark, it is affected by noise. That is, the pitch mark is assigned to the peak of the output waveform of the adaptive low-pass filter. Although the cutoff frequency is set such that the adaptive low-pass filter passes only the fundamental waves of the speech. However, the noise naturally exists in the band as well. Due to the effect of the noise, the output waveform is not a sine wave. As a result, the interval of the peak positions becomes not equal, and the F0 stability decreases.

The fundamental frequency stability calculating unit 103 calculates the F0 stability (step S103). The pitch mark assigned by the pitch mark assigning unit 102 is used for the calculation. The interval between the adjacent pitch marks corresponds to the fundamental period. Thus, the fundamental frequency stability calculating unit 103 obtains the fundamental frequency (F0) by calculating the reciprocal of the interval. FIG. 3(*a*) represents the fundamental frequency for each pitch mark. FIG. 3(*a*) indicates that the fundamental period fluctuates finely in a short period of time. As a method for calculating the temporal F0 stability of the calculated fundamental frequency, the F0 stability can be calculated by calculating a deviation from an average value of the predetermined period. The F0 stability shown in FIG. 3(*b*) can be obtained through this process.

The stable analyzed period extracting unit 104 extracts the periods where the fundamental frequency F0 is stable (step S104). More specifically, when the F0 stability (Equation 5) at each pitch-marked time is smaller than a predetermined threshold, it is determined that the analysis result at that time is stable. Subsequently, the stable analyzed period extracting unit 104 extracts the period where the sound source feature is stably analyzed. FIG. 3(*c*) indicates an example in which the stable periods are extracted through threshold processing.

The stable analyzed period extracting unit 104 may further extract only the periods longer than the predetermined length of time as the stable period, from among the extracted stable periods. With this, it is possible to prevent extraction of very short stable periods, allowing extraction of the period in which the sound source is more stably analyzed. FIG. 3(*d*) shows an example with the fine stable periods removed.

The vocal tract feature interpolation unit 105 interpolates the vocal tract feature in the period where the stable analysis cannot be performed due to the effect of noise, using the vocal tract feature in a period where the stable analyzed period extracting unit 104 performs stable analysis (step S105). More specifically, the vocal tract feature interpolation unit 105 approximates a coefficient of each dimension of the PARCOR coefficient which is the vocal tract feature, using multinomial factor in a predetermined sound period (phoneme period, for example). Here, using only the PARCOR coefficients in a period determined as stable by the stable analyzed period extracting unit 104 allows interpolation of the PARCOR coefficient in a period determined as unstable.

FIG. 4 shows an example in which the PARCOR coefficient which is the vocal tract feature is interpolated by the vocal tract feature interpolation unit 105. In FIG. 4, the broken line represents the analyzed primary PARCOR coefficient. The solid line represents the PARCOR coefficient interpolated by using the stable period extracted in step S104.

The sound source feature averaging unit 106 averages the sound source feature (step S106). More specifically, stable sound source feature can be extracted by averaging the sound source feature parameter with respect to the predetermined speech period (for example, the voiced sound period, the phoneme period and others).

Figure 9:
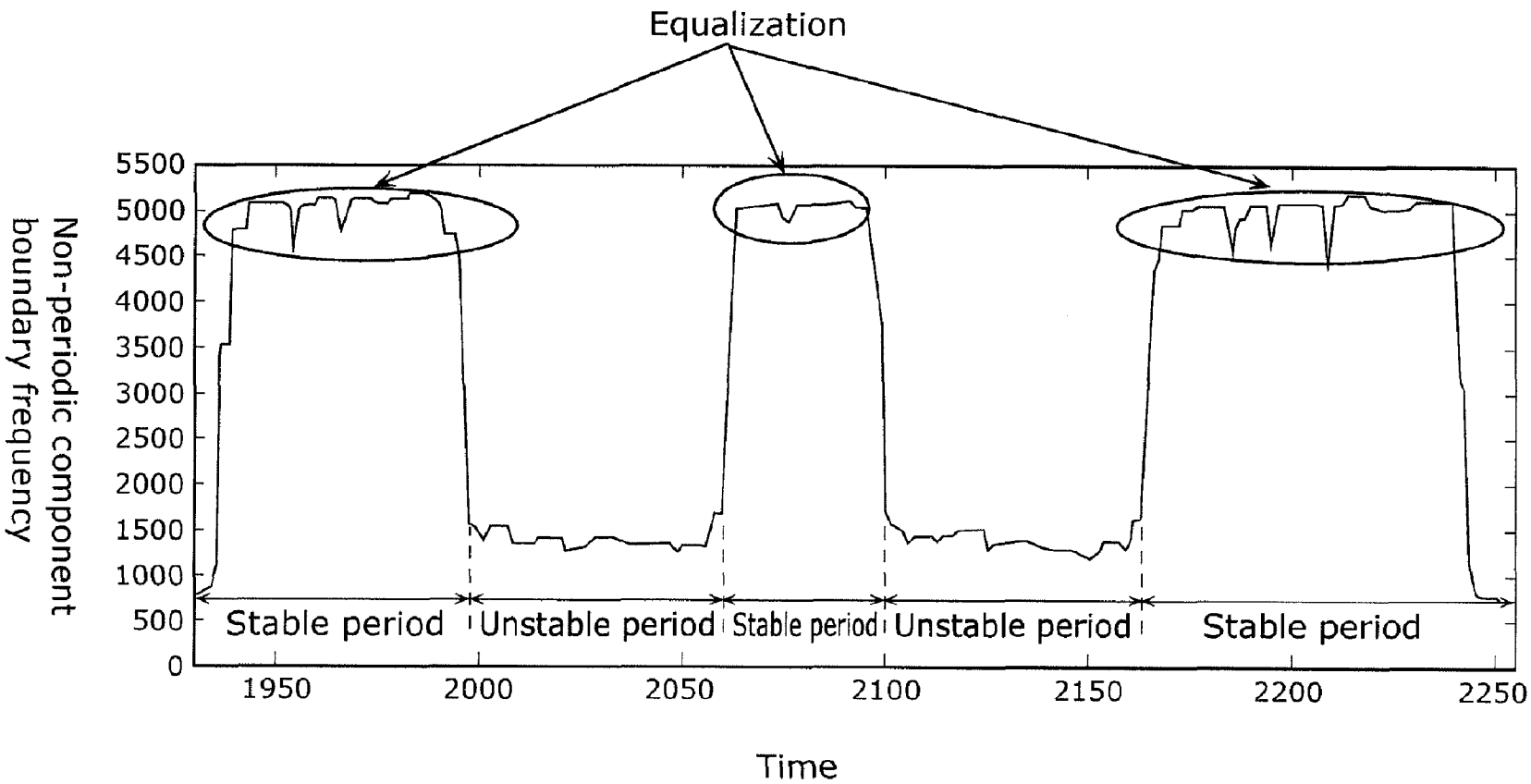
FIG. 9 is a diagram for describing averaging of the non-periodic component boundary frequency by the sound source feature averaging unit.

FIG. 9 is a chart showing the analysis result of the non-periodic component boundary frequency, which is one of the sound source features. The non-periodic component boundary frequency is the sound source feature with small effect due to phoneme. Accordingly, it is possible to represent the non-periodic component boundary frequency in the unstable period, using the average value of the non-periodic component boundary frequency in the stable period included in the same phoneme period. Note that, when performing the averaging, the deviation from the average value of the non-periodic component boundary frequency may be added to the average value of the non-periodic component boundary frequency in the stable period. Alternatively, the non-periodic component boundary frequency in the unstable period may be interpolated using the non-periodic component boundary frequency in the stable period, in the same manner as the vocal tract feature. The other sound source features such as the open quotient and the sound source spectral tilt may be represented by the average value in the stable period.

(Effect)

The above-described structure allows reconstruction of the vocal tract feature and the sound source feature not included in the period, based on the period in which the sound source feature is stably analyzed, and based on the vocal tract feature and the sound source feature included in the period. For this reason, even when the noise is suddenly mixed to the input speech, it is possible to highly precisely analyze the vocal tract feature and the sound source feature which are personal features of the input speech without the effect of noise, without affected by the noise.

Using the vocal tract feature of the thus extracted input audio and the sound source feature allows a use of the voice quality feature of the target speaker unaffected by the noise, even when changing the voice quality. This provides an effect that the speech in which the high-sound quality and highly personal voice change is performed can be obtained. Specific method for the voice change is not particularly restricted. However, the voice change disclosed in the Japanese Patent No. 4294724 can be used, for example.

Furthermore, one-dimensional sound source waveform as shown in FIG. 2 can be used as the sound source feature. Thus, the stability of the fundamental frequency of the input speech in the sound source feature can be calculated by a simple process.

Note that the order of the vocal tract feature interpolation (step S105 in FIG. 5) and the sound source feature averaging (step S106 in FIG. 5) is not restricted. Accordingly, the vocal tract feature interpolation (step S105 in FIG. 5) may be performed after the sound source feature averaging (step S106 in FIG. 5)

(Variation)

Figure 10:
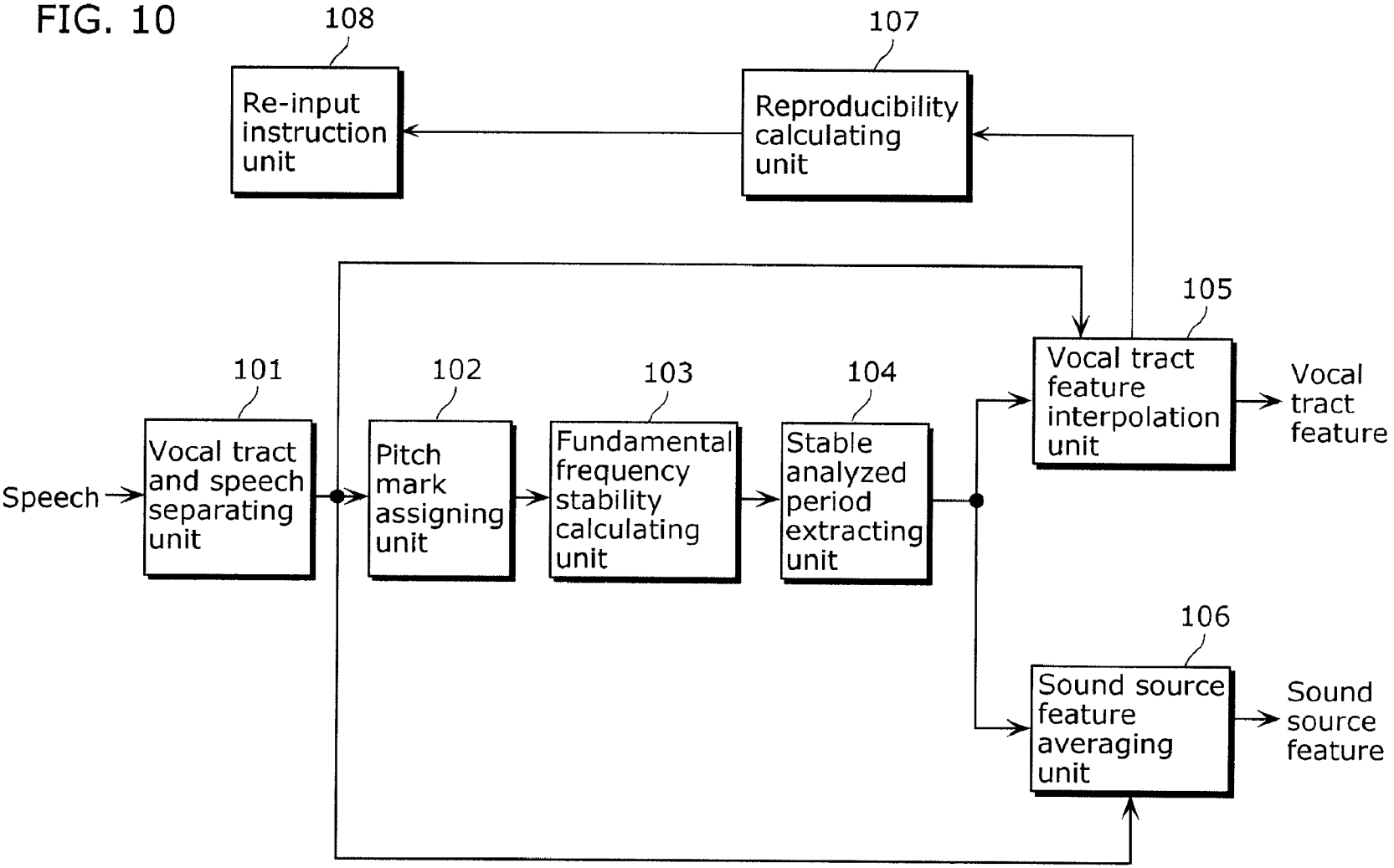
FIG. 10 is a block diagram showing functional structure of the speech analyzer according to a variation of the embodiment of the present invention.
Figure 11:
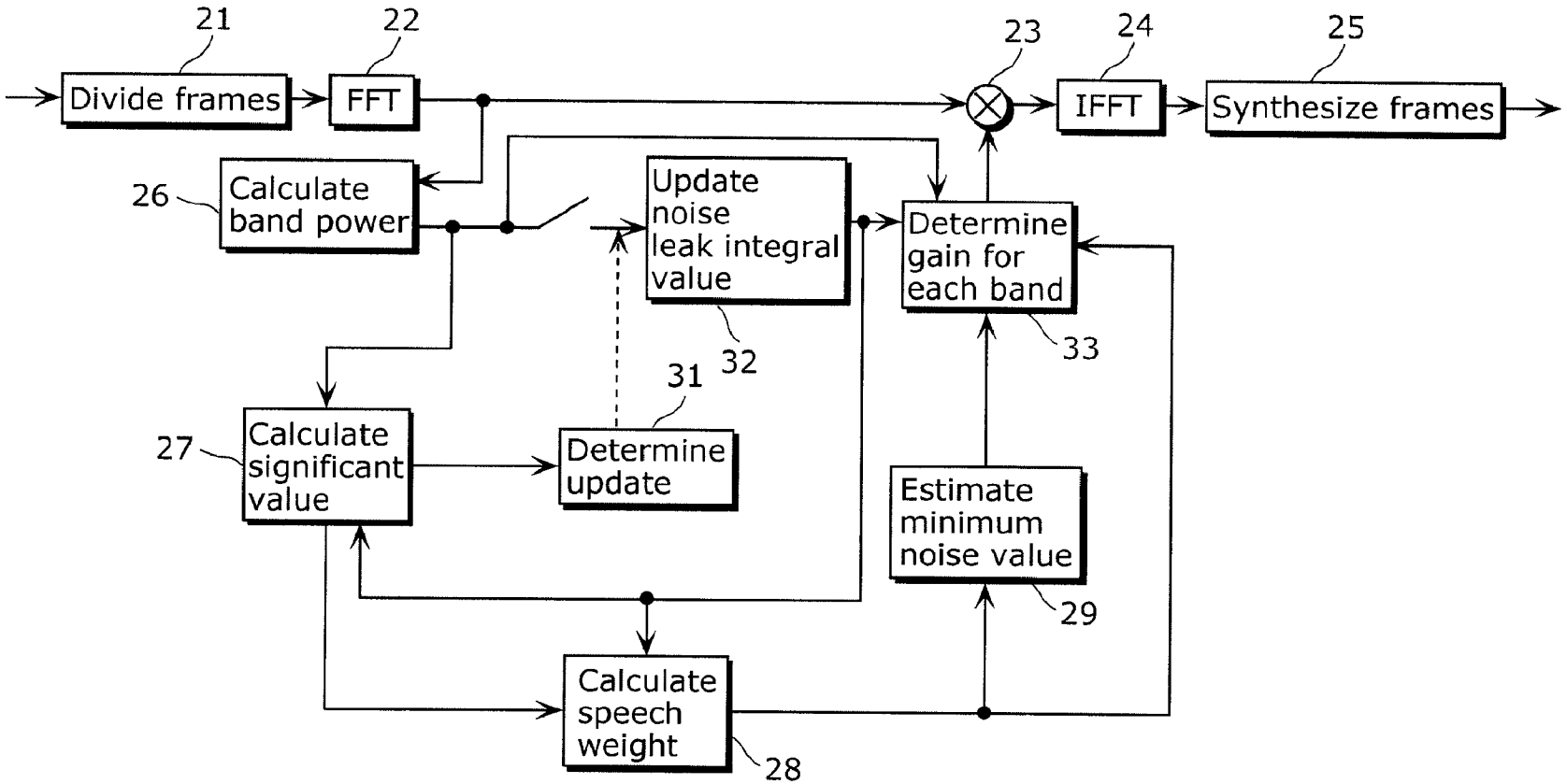
FIG. 11 PRIOR ART
FIG. 11 is a block diagram showing the structure of a conventional noise suppressing device.

Note that, as shown in FIG. 10, the speech analyzer may further include a reproducibility calculating unit 107 and the re-input instruction unit 108.

In this case, the reproducibility calculating unit 107 calculates a degree of reconstruction of the vocal tract feature by the vocal tract feature interpolation unit 105, and determines whether or not the reconstruction is sufficient. When the reproducibility calculating unit 107 determines that the degree of reconstruction is not sufficient, the re-input instruction unit 108 outputs an instruction prompting a user to input the speech.

More specifically, the reproducibility calculating unit 107 calculates the reproducibility as defined below. The reproducibility is defined as a reciprocal of the error when approximating the factor in the stable period, when interpolating the vocal tract feature by approximating the factor (polynomial, for example) by the vocal tract feature interpolation unit 105. When the reproducibility calculated by the reproducibility calculating unit 107 is smaller than a predetermined threshold, the re-input instruction unit 108 instructs the user with a prompt to re-input the speech (for example, display a message).

The structure of the speech analyzer described above allows the extraction of the personal features (vocal tract feature and the sound source feature) unaffected by the noise by causing the user to re-input the speech, when a high-precision analysis of the personal feature cannot be performed due to a large effect of the noise.

Note that, the reproducibility calculating unit 107 may define the ratio of the length of the stable period extracted by the stable analyzed period extracting unit 104 with respect to the length of the period in which the vocal tract feature is interpolated by the vocal tract feature interpolation unit 105 (a period for tens of msec, for example), and causes the re-input instruction unit 108 to prompt the re-input by the user.

This can avoid the unrecoverable effect due to noise by causing the user to utter the speech again, when the effect of noise ranges a relatively long period of time.

The description for the speech analyzer according to the embodiment of the present invention has been above. However, the present invention is not limited to the embodiments.

Each of the aforementioned apparatuses is, specifically, a computer system including a microprocessor, a ROM, a RAM, a hard disk unit, a display unit, a keyboard, a mouse, and the so on. A computer program is stored in the RAM or hard disk unit. The respective apparatuses achieve their functions through the microprocessor's operation according to the computer program. Here, the computer program is configured by combining plural instruction codes indicating instructions for the computer.

A part or all of the constituent elements constituting the respective apparatuses may be configured from a single System-LSI (Large-Scale Integration). The System-LSI is a super-multi-function LSI manufactured by integrating constituent units on one chip, and is specifically a computer system configured by including a microprocessor, a ROM, a RAM, and so on. A computer program is stored in the RAM. The System-LSI achieves its function through the microprocessor's operation according to the computer program.

A part or all of the constituent elements constituting the respective apparatuses may be configured as an IC card which can be attached and detached from the respective apparatuses or as a stand-alone module The IC card or the module is computer systems composed by a microprocessor, a ROM, a RAM, and others. The IC card or the module may also be included in the aforementioned super-multi-function LSI. The IC card or the module achieves its function through the microprocessor's operation according to the computer program. The IC card or the module may also be implemented to be tamper-resistant.

Alternatively, the present invention may be a method described above. The present invention may be a computer program for realizing the previously illustrated method, using a computer, and may also be a digital signal including the computer program.

Furthermore, the present invention may also be realized by storing the computer program or the digital signal in a computer readable recording medium such as flexible disc, a hard disk, a CD-ROM, an MO, a DVD, a DVD-ROM, a DVD-RAM, a BD (Blu-ray Disc), and a semiconductor memory. Alternatively, the present invention may be the digital signal recorded on the recording medium.

Furthermore, the present invention may also be realized by the transmission of the aforementioned computer program or digital signal via a telecommunication line, a wireless or wired communication line, a network represented by the Internet, a data broadcast and so on.

The present invention may also be a computer system including a microprocessor and a memory, in which the memory stores the aforementioned computer program and the microprocessor operates according to the computer program.

Furthermore, by transferring the program or the digital signal by recording onto the aforementioned recording media, or by transferring the program or digital signal via the aforementioned network and the like, execution using another independent computer system is also made possible.

Furthermore, the embodiment and the variation may be combined as well.

Although only some exemplary embodiment of this invention have been described in detail above, those skilled in the art will readily appreciate that many modifications are possible in the exemplary embodiment without materially departing from the novel teachings and advantages of this invention. Accordingly, all such modifications are intended to be included within the scope of this invention.

Industrial Applicability

The present invention is applicable to a speech analyzer that has a function to analyze the vocal tract feature and the sound source feature which are the personal features included in the input speech even in a real environment where there is background noise, and that can extract the speech feature in an actual environment at high precision. Furthermore, it is also useful as a voice changer used in entertainment and others, using the extracted personal feature for voice changing. Furthermore, the personal feature extracted in the real environment is also applicable to a speaker identifier.

What is claimed is:

1. A speech analyzer which analyzes an input speech to extract a vocal tract feature and a sound source feature, said speech analyzer comprising:

a vocal tract and sound source separating unit configured to separate the vocal tract feature and the sound source feature from the input speech, based on a speech generation model obtained by modeling a vocal tract system for a speech;

a fundamental frequency stability calculating unit configured to calculate a temporal stability of a fundamental frequency of the input speech in the sound source feature, from the sound source feature separated by said vocal tract and sound source separating unit;

a stable analyzed period extracting unit configured to extract time information of a stable period of the sound source feature, based on the temporal stability of the fundamental frequency of the input speech in the sound source feature calculated by said fundamental frequency stability calculating unit; and a vocal tract feature interpolation unit configured to interpolate a vocal tract feature which is not included in the stable period of the sound source feature, using a vocal tract feature included in the stable period of the sound source feature extracted by said stable analyzed period extracting unit, from among the vocal tract feature separated by said vocal tract and sound source separating unit, wherein at least one of (i) said vocal tract and sound source separating unit, (ii) said fundamental frequency stability calculating unit, (iii) said stable analyzed period extracting unit, and (iv) said vocal tract feature interpolation unit, comprises hardware.

2. The speech analyzer according to claim 1, further comprising a pitch mark assigning unit configured to extract feature points which repeatedly appear at an interval of a fundamental period of the input speech, from the sound source feature separated by said vocal tract and sound source separating unit, and to assign pitch marks to the extracted feature points, wherein said fundamental frequency stability calculating unit is configured to calculate the fundamental frequency of the input speech in the sound source feature, using the pitch marks assigned by said pitch mark assigning unit and to calculate the temporal stability of the fundamental frequency of the input speech in the sound source feature, using the calculated fundamental frequency.

3. The speech analyzer according to claim 2, wherein said pitch mark assigning unit is configured to extract a glottal closing point from the sound source feature separated by said vocal tract and sound source separating unit, and to assign the pitch mark to the extracted glottal closing point.

4. The speech analyzer according to claim 1, wherein said vocal tract feature interpolation unit is configured to interpolate a vocal tract feature which is not included in the stable period of the sound source feature by approximating, using a predetermined function, the vocal tract feature included in the stable period of the sound source feature extracted by said stable analyzed period extracting unit, from among the vocal tract feature separated by said vocal tract and sound source separating unit.

5. The speech analyzer according to claim 1, wherein said vocal tract feature interpolation unit is configured to interpolate, per predetermined time unit, the vocal tract feature separated by said vocal tract and sound source separating unit.

6. The speech analyzer according to claim 5, wherein the predetermined time unit is a phoneme.

7. The speech analyzer according to claim 1, further comprising a sound source feature reconstructing unit configured to reconstruct a sound source feature in a period other than the stable period of the sound source feature, using the sound source feature included in the stable period of the sound source feature extracted by said stable analyzed period extracting unit, from among the sound source feature separated by said vocal tract and sound source separating unit.

8. The speech analyzer according to claim 7, wherein said sound source feature reconstructing unit is configured to calculate an average value of the sound source feature included in the stable period of the sound source feature extracted by said stable analyzed period extracting unit, from among the sound source feature separated by said vocal tract and sound source separating unit, and to determine the calculated average value of the sound source feature as the sound source feature of the period other than the stable period of the sound source feature.

9. The speech analyzer according to claim 8, wherein said sound source feature averaging unit is configured to add a deviation from the average value of the sound source feature in the period other than the stable period of the sound source feature to the average value of the sound source feature included in the stable period of the sound source feature, and to determine a result of the addition as the sound source feature in the period other than the stable period of the sound source feature.

10. The speech analyzer according to claim 1, further comprising:

a reproducibility calculating unit configured to calculate a reproducibility of the vocal tract feature interpolated by said vocal tract feature interpolation unit; and a re-input instruction unit configured to instruct a user to re-input the speech when the reproducibility calculated by said reproducibility calculating unit is smaller than a predetermined threshold.

11. The speech analyzer according to claim 10, wherein said reproducibility calculating unit is configured to calculate the reproducibility of the vocal tract feature, based on an error of the vocal tract feature before and after the interpolation when said vocal tract feature interpolation unit interpolates the vocal tract feature.

12. The speech analyzer according to claim 1, wherein said vocal tract and sound source separating unit is configured to separate the vocal tract feature and the sound source feature from the input speech, using a linear prediction model.

13. The speech analyzer according to claim 1, wherein said vocal tract and sound source separating unit is configured to separate the vocal tract feature and the sound source feature from the input speech, using an Autoregressive Exogenous model.

14. The speech analyzer according to claim 1, wherein said fundamental frequency stability calculating unit is configured to calculate an auto-correlation value of the sound source feature separated by said vocal tract and sound source separating unit as the temporal stability of the fundamental frequency of the input speech in the sound source feature.

15. A speech analysis method which analyzes an input speech to extract a vocal tract feature and a sound source feature, said speech analysis method comprising:

separating the vocal tract feature and the sound source feature from the input speech, based on a speech generation model obtained by modeling a vocal tract system for a speech;

calculating a temporal stability of a fundamental frequency of the input speech in the sound source feature, from the sound source feature separated in separating;

extracting time information of a stable period of the sound source feature, based on the temporal stability of the fundamental frequency of the input speech in the sound source feature calculated in said calculating; and interpolating a vocal tract feature which is not included in the stable period of the sound source feature, using a vocal tract feature included in the stable period of the sound source feature extracted in said extracting, from among the vocal tract feature separated in said separating.

16. A non-transitory computer-readable medium having a program stored thereon for analyzing an input speech to extract a vocal tract feature and a sound source feature, the program causing a computer to execute:

separating the vocal tract feature and the sound source feature from the input speech, based on a speech generation model obtained by modeling a vocal tract system for a speech;

calculating a temporal stability of a fundamental frequency of the input speech in the sound source feature, from the sound source feature separated in said separating;

extracting time information of a stable period of the sound source feature, based on the temporal stability of the fundamental frequency of the input speech in the sound source feature calculated in said calculating; and interpolating a vocal tract feature which is not included in the stable period of the sound source feature, using a vocal tract feature included in the stable period of the sound source feature extracted in said extracting, from among the vocal tract feature separated in said separating.

* * * * *